US007976189B2

(12) United States Patent
Osborn

(10) Patent No.: US 7,976,189 B2
(45) Date of Patent: Jul. 12, 2011

(54) SKYLIGHT LED LIGHTING SYSTEM

(76) Inventor: Ian Osborn, Littleton, CO (US)

( * ) Notice: Subject to any disclaimer, the term of this patent is extended or adjusted under 35 U.S.C. 154(b) by 364 days.

(21) Appl. No.: 12/070,588

(22) Filed: Feb. 19, 2008

(65) Prior Publication Data

US 2009/0085497 A1 Apr. 2, 2009

Related U.S. Application Data

(63) Continuation-in-part of application No. 11/906,009, filed on Sep. 29, 2007.

(51) Int. Cl.
*F21V 21/00* (2006.01)
*F21V 15/00* (2006.01)

(52) U.S. Cl. ..... 362/249.02; 362/362

(58) Field of Classification Search ..... 362/227, 362/249.02, 362, 800; 315/291, 307, 324
See application file for complete search history.

(56) References Cited

U.S. PATENT DOCUMENTS

| | | | | |
|---|---|---|---|---|
| 6,528,782 | B1 * | 3/2003 | Zhang et al. | 250/226 |
| 6,882,117 | B1 * | 4/2005 | Hughes et al. | 315/291 |
| 7,038,399 | B2 * | 5/2006 | Lys et al. | 315/291 |
| 7,057,821 | B2 * | 6/2006 | Zincone | 359/595 |

* cited by examiner

*Primary Examiner* — Thuy Vinh Tran

(57) ABSTRACT

A skylight LED lighting system is described. The system utilizes LED lights attached to or near a skylight in order to provide a user with the ability to increase the amount of light being directed into an area. The system can utilize a LED controller to allow the user to control the light output intensity. The LED controller provides a smooth range of changing brightness levels. The system can utilize one or more solar cells and batteries to power the LED lights. The system can be controlled via a radio frequency remote control. Additionally, the system can utilize a flexible, skylight-shaped installation housing that can be inserted into the skylight under compression. When the compression is released, the ring expands to press against the inside of the skylight and holds the skylight LED lighting system in place.

18 Claims, 10 Drawing Sheets

800

SKYLIGHT LED LIGHTING SYSTEM

CROSS-REFERENCE TO RELATED APPLICATIONS

This application is a continuation-in-part of U.S. patent application Ser. No. 11/906,009, entitled "LED Controller and Lighting System" and filed on Sep. 29, 2007, which is specifically incorporated herein by reference for all that it discloses and teaches.

TECHNICAL FIELD

The invention relates generally to the lighting industry and more particularly to a skylight LED lighting system.

BACKGROUND

Electrical lights have been around for well over 100 years. During that time, many variations and improvements in the technologies utilized to produce light have occurred. One of the most recent developments has been the widespread adoption of Light Emitting Diode (LED) lighting systems as a replacement for older incandescent and fluorescent systems.

In the last twenty years, rapid commercialization of LED technologies has occurred. LED lighting systems can be found in everything from hand-held flashlights to standard floor and desk lamps. In fact, the more powerful LEDs of recent manufacture are even being utilized in large-scale outdoor lighting projects.

Nevertheless, while LED lights have made impressive inroads in many areas of the lighting industry, current LED systems still have a few problems and limitations. One such limitation is the general lack of LED controller systems that provide varying intensity outputs for LED lighting systems. A variety of multi-step systems are available, but the resulting lighting effect is similar to a standard three-way incandescent bulb in that three predefined levels of brightness are apparent rather than a smooth increasing and decreasing of the light output levels.

Another technology that is often utilized in LED systems is called a Pulse Width Modulator (PWM). PWMs are used to control the light output of LEDs. A PWM acts by providing segmented pulses of voltage to a LED, causing a flashing or pulsing effect in the light output of the LED. The pulsing effect causes the human eye to perceive an erratic flashing effect when a PWM is used to dim or brighten LED lights. Thus, a need exists for a LED controller and lighting system that can smoothly increase and decrease LED light output intensities without utilizing apparent brightness steps/levels or causing a pulsing of the LED.

As LED lighting systems have grown and evolved so too have passive solar lighting solutions, i.e., skylights. One common embodiment has seen a recent surge in installations because of its flexibility: the tube skylight. The traditional skylight is a window-like device that is placed in the roof of a building and allows sunlight to shine in from above. If a building has an attic area beneath the roof, it is difficult to utilize a traditional skylight since the attic blocks the path of the sunlight into the interior of the building. In such a situation, a serviceable alternative is the tube skylight. Tube skylights utilize a cylindrically shaped pipe, tube or other similar structure to direct and funnel the outside light from the skylight through an attic and into the ceiling of a room in the interior of a building. The inside of the tube-structure is reflective, allowing the structure to be bent, angled, and turned without significantly reducing the amount of outside light transmitted to the room below.

Although the tube skylight has significant advantages over the traditional skylight, both suffer from the same inherent deficiency: at night (or on cloudy days), there is little outside light for a skylight to transmit into a building. In order to overcome this shortcoming, lighting companies have begun to offer incandescent add-on lights that can be attached to skylights. However, installations of such lights usually require the services of an electrician since standard household alternating current is used to power the lights. Furthermore, the additional wiring that is required can add considerable expense to the lighting project. Additional problems with the traditional incandescent approach include: relatively low efficiency, high heat output per lumen of light, large size, difficulty installing and changing bulbs, etc. Therefore, there is a need for a skylight lighting add-on that is efficient, comparatively cool, and relatively inexpensive and simple to install.

SUMMARY

Embodiments described and claimed herein address the foregoing problems by providing a skylight LED lighting system. The system can utilize an LED controller to allow the user to control the output intensity of one or more LED lighting systems. The intensity levels or brightness of the LED lights are not limited to 3, 4 or even 10 levels of light output; instead, the LED controller provides what appears to the human eye as a smooth range of changing brightness levels, depending on the needs of the user. Furthermore, the system does not require expensive rewiring since it can utilize one or more solar cells and batteries or power storage devices to power the LED lights. A solar cell can use a portion of the outside light that is transmitted through the skylight to charge its battery. The LED light system can be controlled via a radio frequency remote control unit in order to further simplify the installation process (i.e., a hard-wired control unit does not have to be installed). Because of the small size of the LED lights that are used, their low heat output and simplified wiring, installation of the system is much improved over existing technologies. Additionally, the system can utilize a flexible, skylight-shaped installation housing ring that can be inserted into the skylight under compression. When the compression is released, the housing ring expands to press against the inside of the skylight and holds the skylight LED lighting system in place. Double-sided adhesive safety tape can be used to ensure the security and stability of the installation.

BRIEF DESCRIPTION OF THE DRAWINGS

The aforementioned and other features and objects of the present invention and the manner of attaining them will become more apparent and the invention itself will be best understood by reference to the following description of a preferred embodiment and other embodiments taken in conjunction with the accompanying drawings, wherein.

DETAILED DESCRIPTION

In one embodiment, a LED controller utilizes United States standard residential alternating current (A/C) as a power source (either 110 volt or 220 volt). In another embodiment, a LED controller utilizes direct current (D/C) as a power source (for example, a 12 volt solar-powered system). Other voltage types and sources are contemplated.

A LED controller can be a component in a skylight LED lighting system. In one embodiment, a LED controller is used within a skylight LED lighting system to provide a dimming and brightening function. In such a system, a 12 volt solar cell can act as the D/C power source (other voltage types and amounts are contemplated). In another such system, a standard A/C power source is used.

Figure 1:
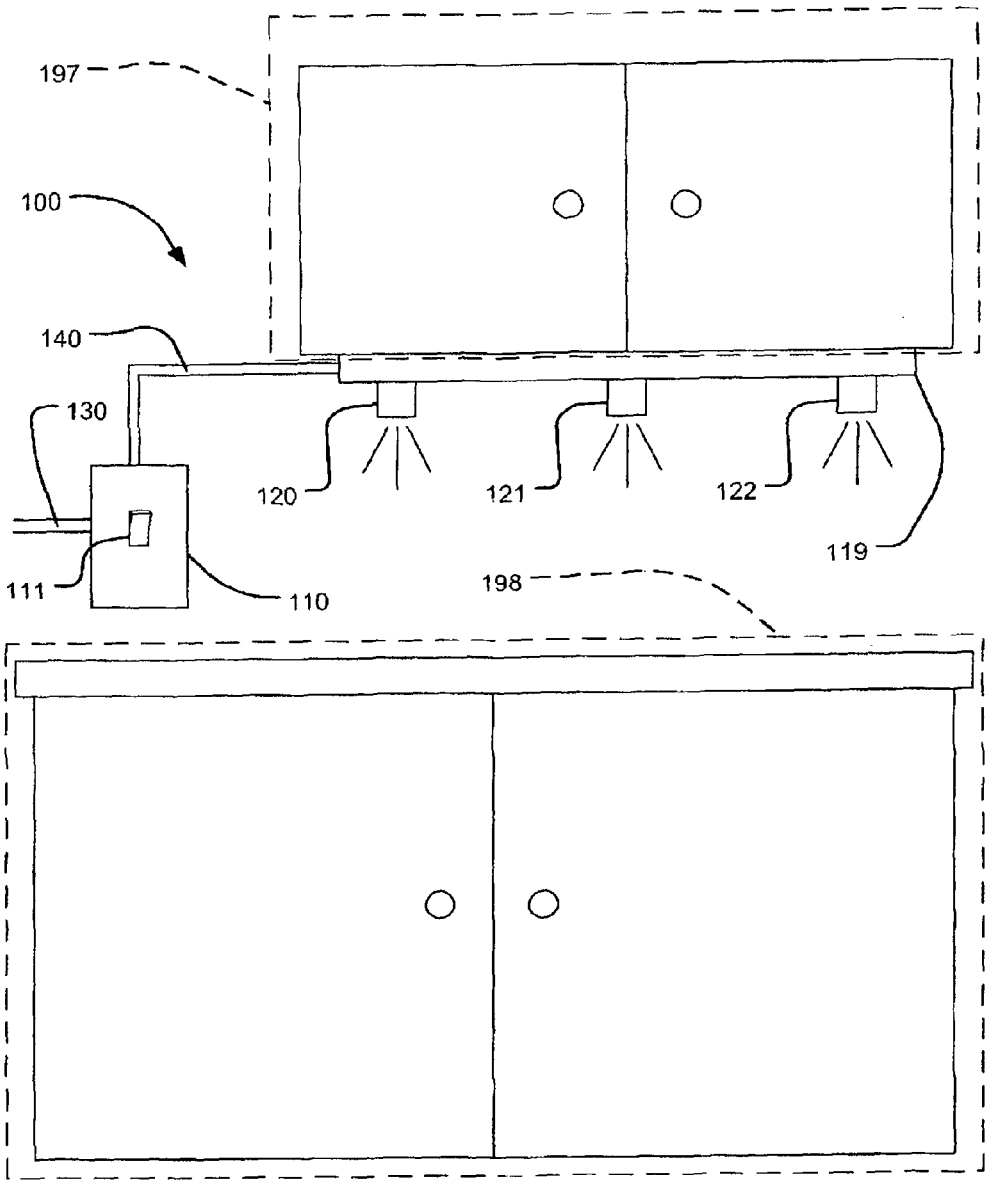
FIG. 1 illustrates a view of an exemplary embodiment of a LED controller and lighting system operating on an alternating current power system.

FIG. 1 illustrates an exemplary embodiment of a LED controller and lighting system 100 operating on an A/C power system. The primary components shown in FIG. 1 include: a LED controller 110; a system of LED lights 120, 121, and 122; an A/C power source 130; and the D/C power output 140. The LED controller 110 shown in FIG. 1 is illustrated as a simple switchbox. In other embodiments, other types of switches and/or controls are contemplated. In FIG. 1, the LED controller and lighting system 100 is operating on a standard A/C power source 130. The A/C power source 130 feeds into the LED controller 110. The LED controller 110 contains a number of subcomponents that are not shown in FIG. 1 (see detailed description of the LED controller 110 below). The subcomponents act on the incoming A/C power source 130 and output the D/C power output 140. As shown in FIG. 1, the D/C power output 140 is routed directly to the LED lighting system 120, 121, and 122. However, in alternate embodiments, the D/C power output 140 could connect to other components before being routed to the LED lighting system 120, 121, and 122.

Once the A/C power source 130 is routed to the LED controller 110, a user of the system can operate the rocker switch 111 to control the light output levels of the lighting system 120, 121, and 122. The LED controller 110 is connected to the lighting system 120, 121, and 122 by the D/C power output 140. Because the LED controller 110 does not rely upon a pulse width modulator (PWM) but instead utilizes a custom-coded microchip (among other components) to vary the light intensity of the lighting system 120, 121, and 122, the user will experience a gradual increasing or decreasing of light brightness/intensity while operating the rocker switch 111 instead of a pulsing or flashing effect common to PWM systems.

The lighting system 120, 121, and 122 as shown in FIG. 1 only has three LED lights. In other embodiments, the lighting system 120, 121, and 122 can contain fewer lights or more lights than that shown in FIG. 1. Furthermore, the lighting system 120, 121, and 122 can be composed of LED lights having different colors, sizes, shapes, intensities, etc. The lighting system 120, 121, and 122 components are illustrated in the embodiment in FIG. 1 as being mounted in a box-shaped mounting bracket 119. In other embodiments, the lighting system is employed without the use of a mounting bracket 119. FIG. 1 also shows a set of hanging wall cabinets 197. The hanging cabinets 197 are for illustrative purposes and are not an integral part of a LED controller and lighting system 100. Similarly, FIG. 1 also includes a set of base cabinets with countertop 198. The base cabinets with countertop 198 are for illustrative purposes and do not form a part of the LED controller and lighting system 100.

Figure 2:
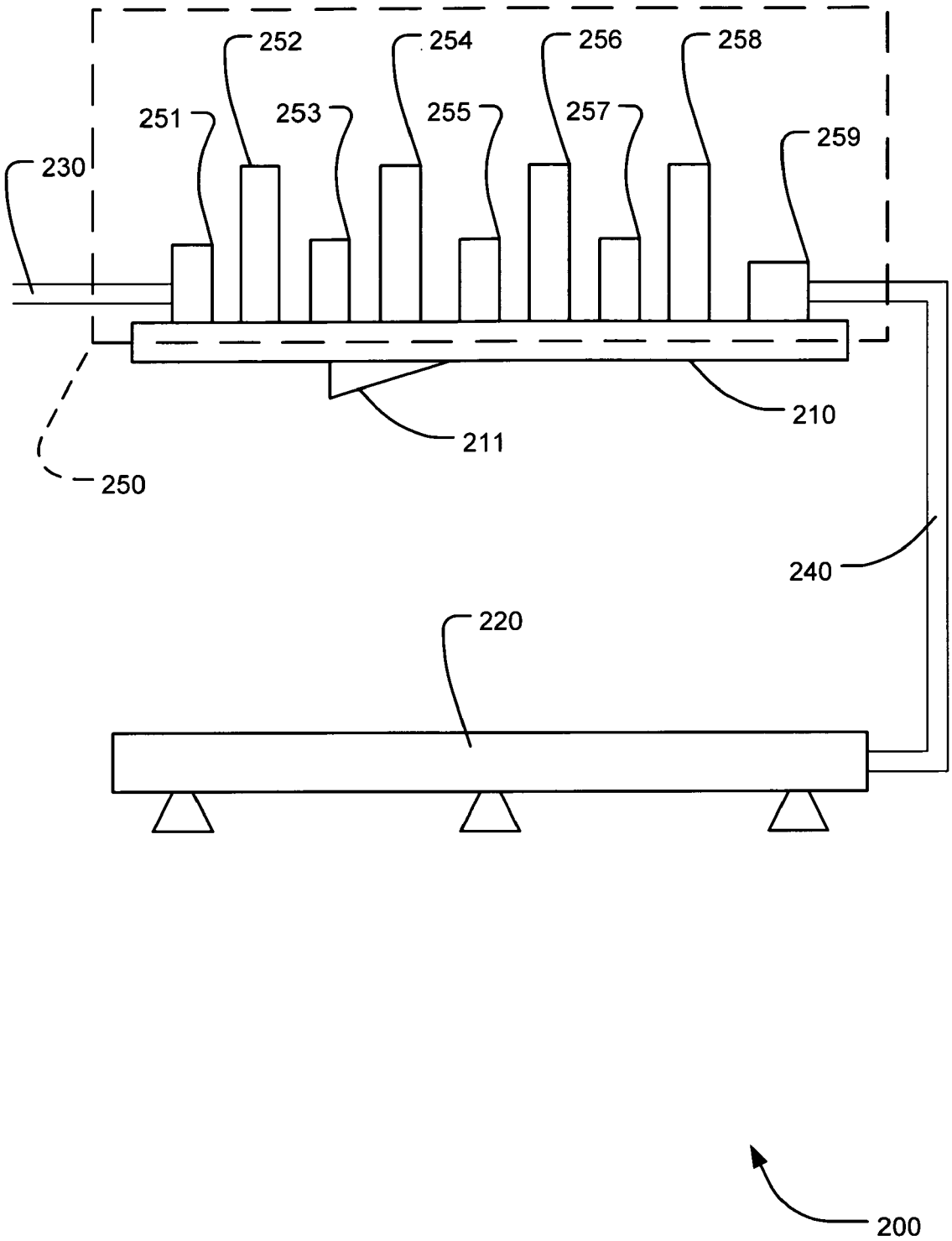
FIG. 2 illustrates a close-up view of an exemplary embodiment of a LED controller and lighting system operating on an alternating current power system.

FIG. 2 illustrates a close-up view of an exemplary embodiment of a LED controller and lighting system 200 operating on an A/C power system. In the embodiment in FIG. 2, a switch plate 210 can be used to bring the A/C power from the A/C power source 230 to the terminal blocks 251. The switch plate 210 holds the LED controller 250 in position and the line wires coming from the A/C power source 230 bring the A/C power to the terminal blocks 251 to start the rectification of power to a D/C source. As shown in FIG. 2, the subcomponents of the LED controller 250 are represented by simple rectangles. Furthermore, in alternate embodiments, other subcomponents arranged in similar or different ways are contemplated.

Power is brought in to the LED controller 250 through the terminal blocks 251. The terminal blocks can consist of any components or subcomponents which function as a power input conduit for the LED controller 250. The terminal blocks 251 route power to a bridge rectifier 252. The bridge rectifier 252 transforms the A/C power into a D/C current. The resulting D/C current is then transferred to a capacitor-input filter 253 to smooth the voltage supply. Alternatively, a voltage regulator can be used either instead of or in addition to the capacitor-input filter 253, both to remove the last of the ripple and to deal with variations in supply and load characteristics.

Once the system has access to a D/C current, the power flow must be regulated. In one embodiment, the unregulated D/C power is routed to a capacitor 254 that subsequently produces a supply of relatively clean, uninterrupted D/C power output. Other embodiments may utilize other means or methods of regulating the D/C power. Furthermore, the power could be cleaned and regulated at a completely different location in the circuit, in yet another embodiment. Depending on the specific voltage requirements of other components, an additional voltage regulator 255 could be utilized to bring the exemplary 12 volt D/C current down to a 5 volt D/C current if needed for a 5 volt microchip, for example.

The resulting D/C current is then routed to a microchip 256. In one embodiment, a pre-programmed, static microchip 256 design is used. In another embodiment a re-programmable microchip 256 is used. Regardless of the type of microchip 256 used, its main function is to control the output of the 12 volt signal to the LED lighting system 220 in order to provide dimming and brightening of the LED lighting system 220. This is accomplished by using a programmable code-based microchip 256 that uses an oscillation chip with two hundred and fifty-five or more incremental steps rather than the segmented pulses of a standard PWM. In alternate embodiments, fewer than two hundred and fifty-five incremental steps may be used. In yet another embodiment, more than two hundred and fifty-five incremental steps may be used. Providing incremental steps at a much greater numerical value results in a smooth up and down transition of brightness/intensity of the LED lighting system 220 while maintaining the 12 volt D/C voltage supply. The transition of light output from low intensity to maximum intensity is achieved without the flickering effect of the traditional PWM. The program can be set to dim or intensify in variable increments. Those increments can be either an instantaneous change or a smooth transition without the flickering visual effect. This non-flickering effect is a result of the custom programming of the microchip 256.

In one embodiment, the microchip 256 is programmed to provide a range of brightness from 25% to 75% of the LED lighting system's 220 maximum lumens. In another embodiment, the microchip 256 specifies that on initial power-up, the LED lighting system 220 produces 10% output and then slowly progresses to 100% output over a 30 second period; while a user can halt the progression at any time.

A number of additional capacitors 257 and additional resistors 258 are also utilized throughout the LED controller in order to regulate power, depending upon the desired leg from the microchip 256 and its final function. The additional legs can be used to show and verify that the system has power to a unit (i.e., a LED on the unit showing that the system has power and is functioning). One or more additional LEDs can be used to show if a unit is at fault or has a line short, has crossed wires or a polarity problem, etc. Additional capacitors 257 and additional resistors 258 are utilized to provide the correct power requirements to the LEDs in order to activate them and the corresponding function(s).

In addition to the programmable microchip 256 dimming/brightening functions, the user can also manually affect the dimming/brightening. This is accomplished by operating a rocker switch 211 built into the switch plate 210 described above. The rocker switch 211 sends a signal to the microchip 256 to manually brighten or dim the LED lighting system 220.

The LED controller 250 has a set of outbound terminals 259. The outbound terminals 259 provide the conduit that allows outbound flow of D/C power output 240 from the LED controller 250 to the LED lighting system 220. In the embodiment shown in FIG. 2, the LED lighting system 220 has three LED lights. Other embodiments with a different number of LED lights are contemplated.

The controller 250 shown in FIG. 2 can be utilized as a controller component in a skylight LED lighting system (reference the controller 650 component in the detailed description of FIG. 6 below as an example).

Figure 3:
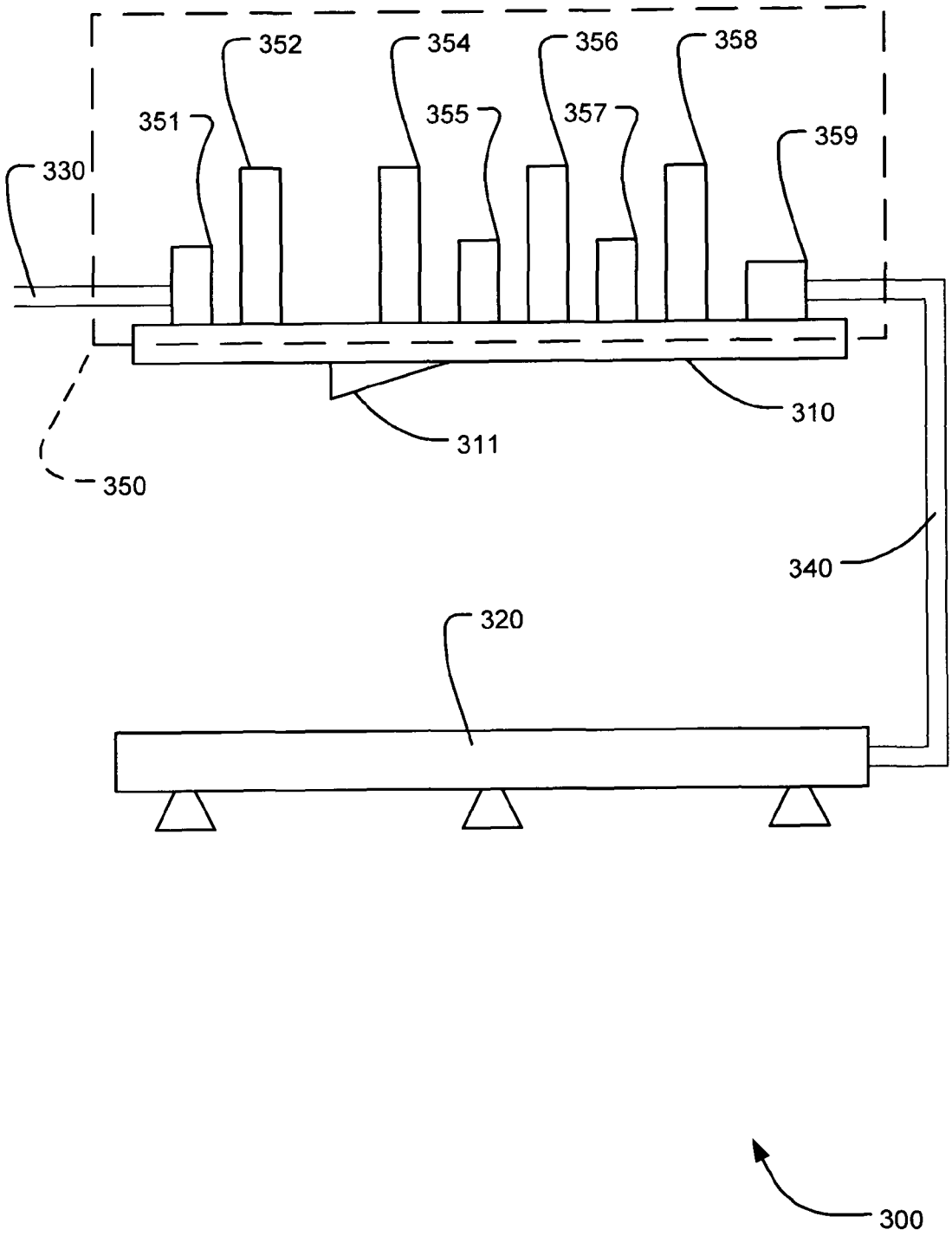
FIG. 3 illustrates a close-up view of an exemplary embodiment of a LED controller and lighting system operating on a direct current power system.

FIG. 3 illustrates a close-up view of an exemplary embodiment of a LED controller and lighting system 300 operating on a D/C power system. In the embodiment in FIG. 3, a switch plate 310 can be used to bring the D/C power from the D/C power source 330 to the terminal blocks 351. The switch plate 310 holds the LED controller 350 in position and the line wires coming from the D/C power source 330 bring the D/C power to the terminal blocks 351. As power is brought in to the LED controller 350 from the terminal blocks 351 it is routed to a voltage regulator 352 to bring the voltage to 12 volts D/C. Other voltages are contemplated.

In one embodiment, the unregulated D/C power is routed to a capacitor 354 that subsequently produces a supply of relatively clean, uninterrupted D/C power output. Other embodiments may utilize other means or methods for regulating the D/C power. Furthermore, the power could be cleaned and regulated at a completely different location in the circuit, in yet another embodiment. Depending on the specific voltage requirements of other components, an additional voltage regulator 355 could be utilized to bring the exemplary 12 volt D/C current down to a 5 volt D/C current if needed for a 5 volt microchip, for example.

The resulting D/C current is then routed to a microchip 356. In one embodiment, a pre-programmed, static microchip 356 design is used. In another embodiment a re-programmable microchip 356 is used. Regardless of the type of microchip 356 used, its main function is to control the output of the 12 volt signal to the LED lighting system 320 in order to provide dimming and brightening of the LED lighting system 320. This is accomplished by using a programmable code-based microchip 356 that uses an oscillation chip with two hundred and fifty-five or more incremental steps rather than the segmented pulses of a standard PWM. In alternate embodiments, fewer than two hundred and fifty-five incremental steps may be used. Providing incremental steps at a much greater numerical value results in a smooth up and down transition of brightness/intensity of the LED lighting system 220 while maintaining the 12 volt D/C voltage supply. The transition of light output from low intensity to maximum intensity is achieved without the flickering effect of the traditional PWM. The program can be set to dim or intensify in variable increments. Those increments can be either an instantaneous change or a smooth transition without the flickering visual effect. This non-flickering effect is a result of the custom programming of the microchip 356.

In one embodiment, the microchip 356 is programmed to provide a range of brightness from 50% to 100% of the LED lighting system's 320 maximum lumens. In another embodiment, the microchip 356 specifies that on initial power-up, the LED lighting system 320 produces 10% output and then slowly progresses to 80% output over a 20 second period; while a user can halt the progression at any time.

A number of additional capacitors 357 and additional resistors 358 are also utilized throughout the LED controller 350 in order to regulate power, depending upon the desired leg from the microchip 356 and its final function. The design of the LED controller 350 and additional legs can be used to attach a remote controlled RF modulator. The RF modulator can then perform the same functions as the rocker switch 311 to dim and/or brighten the lights.

In addition to the programmable microchip 356 dimming/brightening functions, the user can also manually affect the dimming/brightening. This is accomplished by operating a rocker switch 311 built into the switch plate 310 described above. The rocker switch 311 sends a signal to the microchip 356 to manually brighten or dim the LED lighting system 320. The LED controller 350 has a set of outbound terminals 359. The outbound terminals 359 provide the conduit that allows outbound flow of D/C power output 340 from the LED controller 350 to the LED lighting system 320.

The controller 350 shown in FIG. 3 can be utilized as a controller component in a skylight LED lighting system (reference the controller 650 component in the detailed description of FIG. 6 below as an example).

Figure 4:
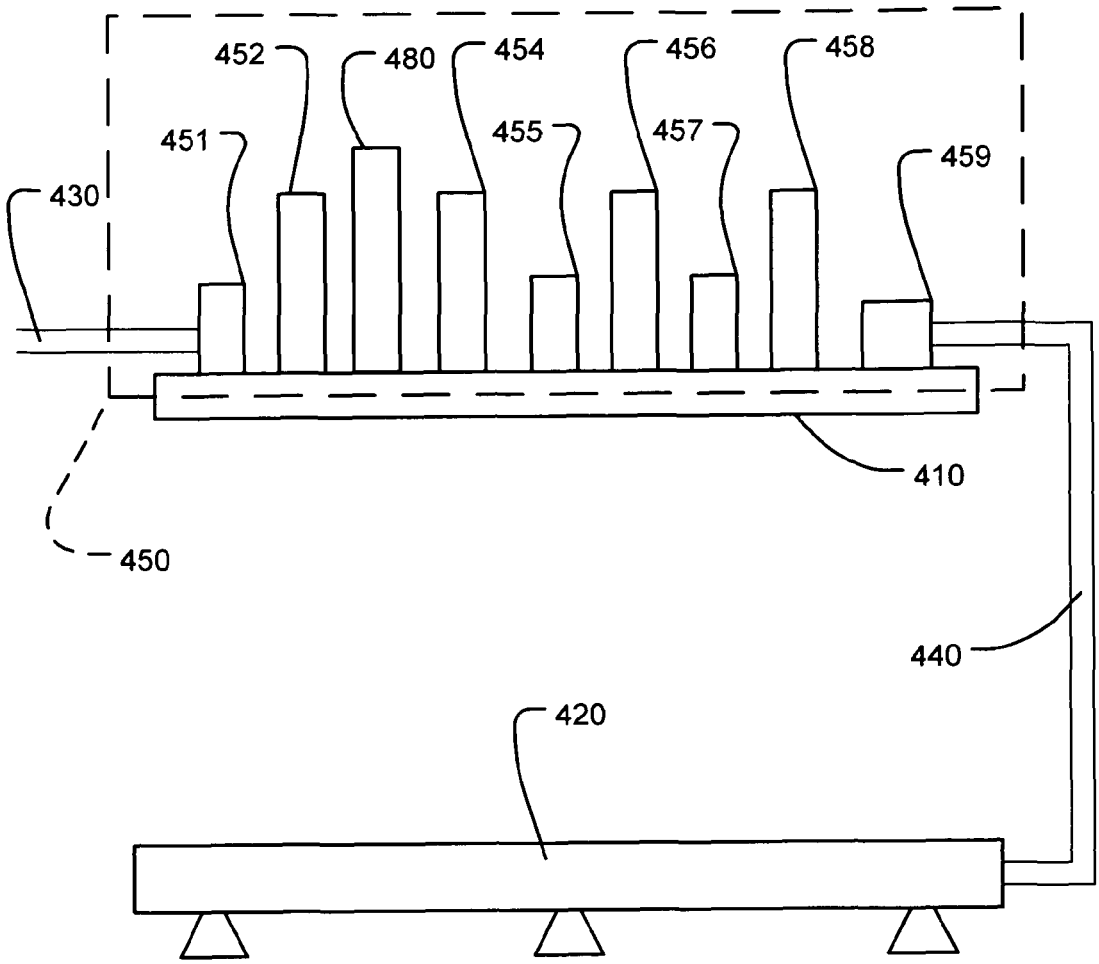
FIG. 4 illustrates a view of an exemplary embodiment of a LED controller and lighting system that utilizes a radio frequency module for wireless remote control functionality.
Figure 4:
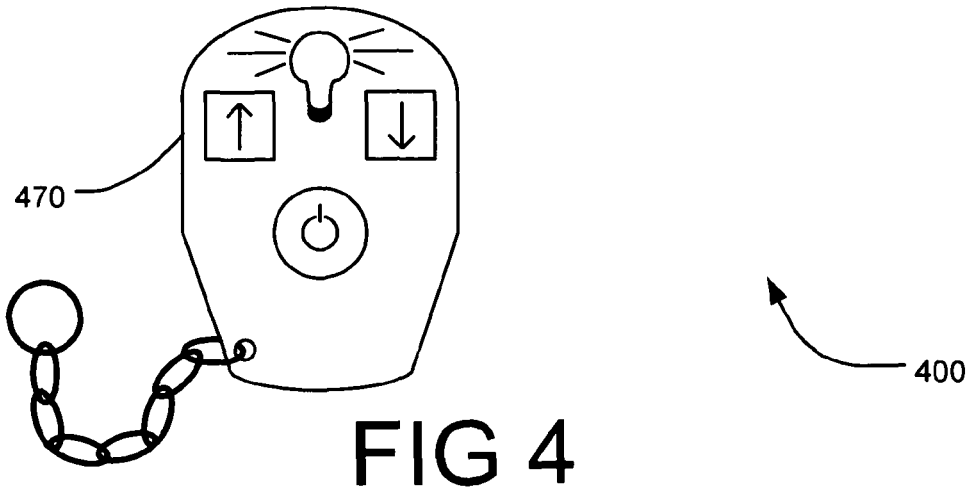

FIG. 4 illustrates a view of an exemplary embodiment of a LED controller and lighting system 400 that utilizes a radio frequency (RF) module 470 for remote control functionality. The LED controller 450 is similar to that shown in FIG. 3 in that it utilizes a D/C power source 430. However, instead of having a manual user control in the form of a rocker switch on the switch plate 410, the embodiment in FIG. 4 utilizes a RF module 470 to allow the user to wirelessly control the brightness/dimming features of the LED controller 450 in order to brighten or dim the LED lighting system 420. As can be seen in FIG. 4, the rocker switch 311 on the switch plate 410 from FIG. 3 has been removed and a RF module 470 with an RF interface 480 to the microchip 456 has been added to the LED controller 450. The remaining LED controller components are similar: the terminal blocks 451, voltage regulator 452, capacitor 454, additional voltage regulator 455, microchip 456, additional capacitors 457, additional resistors 458, and outbound terminals 459. Furthermore, the D/C power output 440 corresponds to that shown in FIG. 3.

The controller 450 shown in FIG. 4 can be utilized as a controller component in a skylight LED lighting system (reference the controller 650 component in the detailed description of FIG. 6 below as an example).

Figure 5:
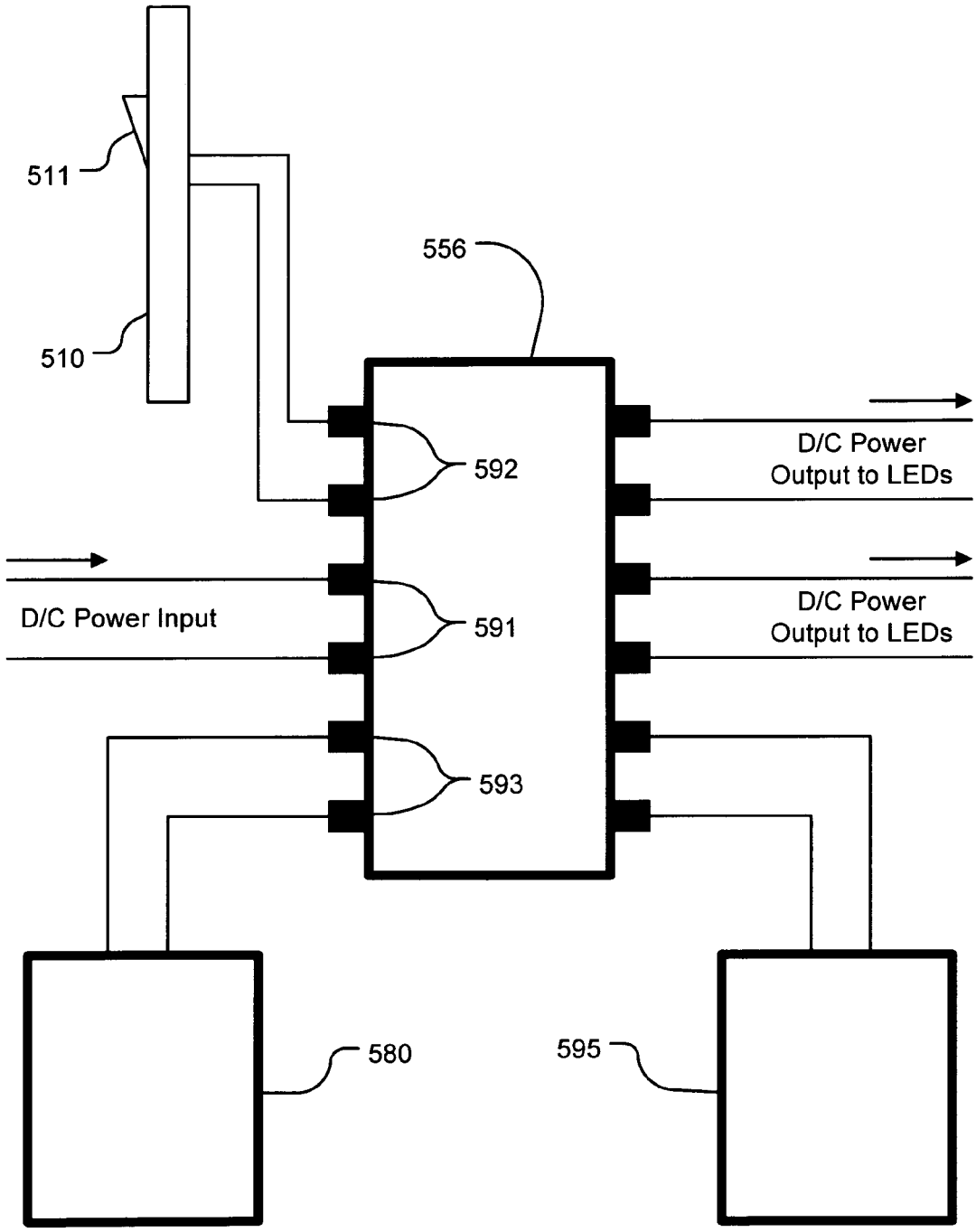
FIG. 5 illustrates a close-up view of an exemplary embodiment of a microchip component of a LED controller and lighting system.

FIG. 5 illustrates a close-up view of an exemplary embodiment of a microchip component 556 of a LED controller and lighting system. As can be seen in FIG. 5, there are a number of inputs and outputs associated with the microchip 556. One set of inputs provides the microchip 556 with its supply of power. In the exemplary embodiment in FIG. 5, the power supply inputs 591 receive 5 volts of clean, regulated D/C power. A second set of inputs, the switch inputs 592, is shown in FIG. 5: they extend from the manual rocker switch 511 in the wall plate 510 to the microchip 556. The rocker switch 511 is triggered manually by the user and signals to the microchip 556 that the LED lighting system should either be dimmed or brightened. In response, the microchip 556 enters a repeating loop process in which the microchip 556 first determines whether the rocker switch 511 is activated. If it is, the microchip 556 then determines the switch state of the rocker switch 511: the switch is set to brighten or the switch is set to dim. In the first case, the microchip 556 increases the intensity level output to the LED lighting system and then enters a programmable-length delay mode before restarting the loop. In the second case, the microchip 556 decreases the intensity level output to the LED lighting system and then enters a programmable-length delay mode before restarting the loop. At the beginning of the loop, the microchip 556 once again determines whether the rocker switch 511 is active or inactive. If active, the loop progresses as above. If inactive, the microchip 556 exits the loop and holds steady the brightness level of the LED lighting system.

In another embodiment, the microchip 556 uses RF inputs 593 to determine the status of the RF interface 580. If the RF interface 580 is active and the rocker switch 511 is active then the microchip 556 enters a programmable-length delay mode before restarting the loop by determining whether the rocker switch 511 and the RF interface 580 are active. If only one of the two is active, the microchip 556 then determines whether the rocker switch 511 or the RF interface 580 is set to brighten or dim. Once that determination is completed, the loop progresses as above: the microchip 556 appropriately modifies the intensity level of the output to the LED lighting system, enters a programmable delay period, and then restarts the loop. If neither of the two is active, the microchip 556 takes no overt action.

In an alternative embodiment, the microchip 556 utilizes a non-volatile memory (NVM) 595 component. The NVM 595 allows the microchip 556 to reset itself to a user-defined or otherwise predetermined brightness/intensity level for the LED lighting system if the power is lost to the LED controller and lighting system.

The microchip 556 shown in FIG. 5 can be utilized within a controller component in a skylight LED lighting system (reference the controller 650 component in the detailed description of FIG. 6 below as an example).

Figure 6:
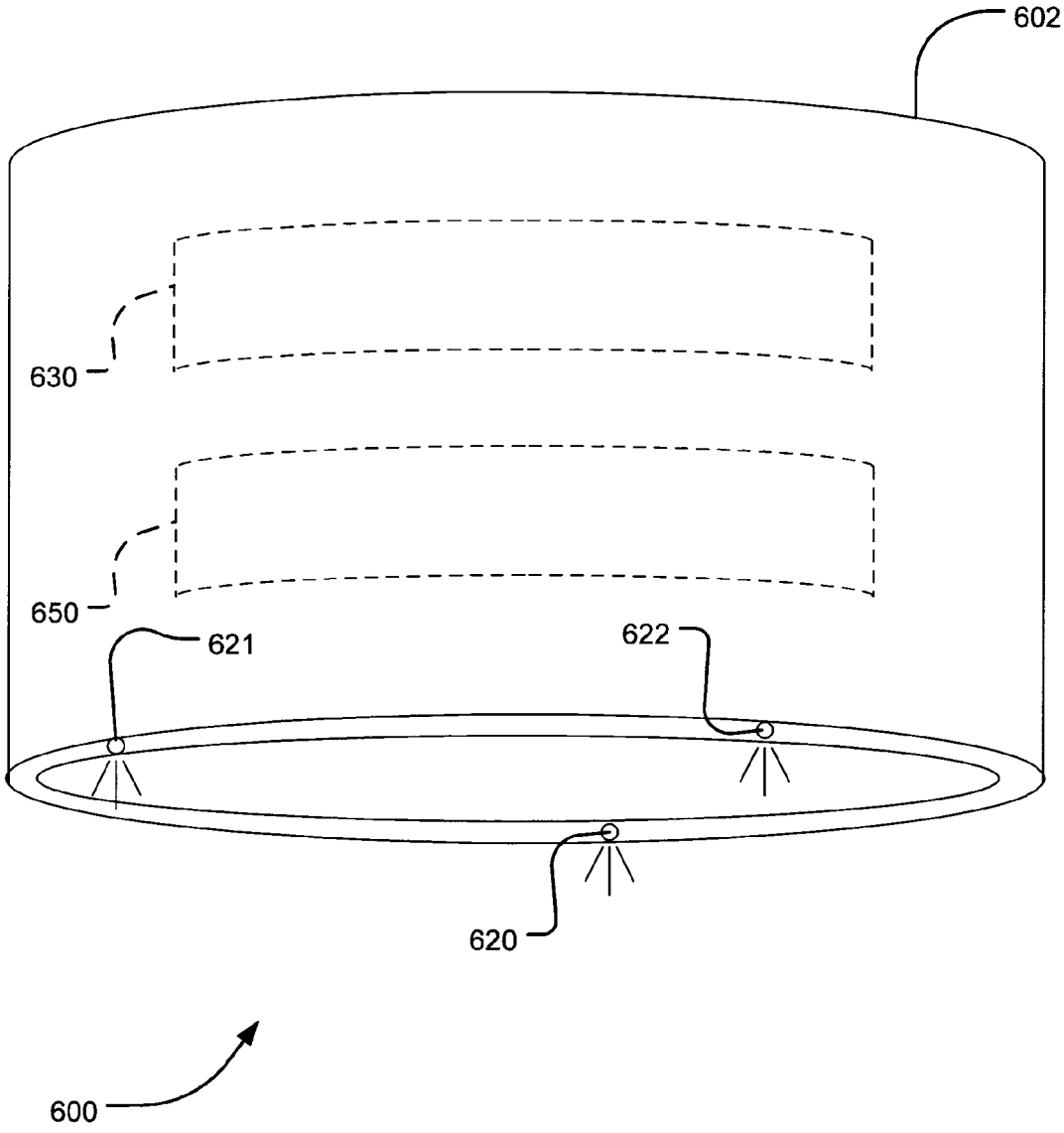
FIG. 6 illustrates a view of an exemplary embodiment of a skylight LED lighting system.

FIG. 6 illustrates a view of an exemplary embodiment of a skylight LED lighting system 600. In the embodiment illustrated in FIG. 6, the skylight LED lighting system 600 is configured to be installed in a tube-style skylight. In other embodiments, traditional square or rectangular style skylights can be used; other types and styles of skylights are contemplated. In the embodiment illustrated in FIG. 6, the primary components of the skylight LED lighting system 600 that are displayed include: a system housing 602; a number of LED lights 620, 621, and 622; a power source 630; and a controller 650.

A system housing 602 can be shaped as needed to fit any type of skylight. As illustrated in FIG. 6, the system housing 602 is a round, ring-shaped device that is placed within the terminating end of a tube-style skylight. Constructing the system housing 602 from a material that is at least somewhat flexible allows the system housing 602 to be compressed and placed within a skylight. The installer then removes the compression causing the system housing 602 to flex back toward its original size. When the housing 602 contacts the interior wall of a skylight, the housing 602 can not flex outward any further and it is effectively locked into place inside the skylight. Additional details explaining this means for securing the system housing 602 can be found in the detailed description of FIG. 10 below.

The number of LED lights 620, 621, and 622 can be greater or less than that shown in FIG. 6. Systems utilizing one, two, three, four, or even five or more LED lights 620, 621, and 622 are contemplated.

The power source 630 shown in FIG. 6 can be a solar cell and battery. The cell receives light from the skylight and converts that light into electricity. The resulting electrical power can be stored in a battery or other form of electrical storage device. The skylight LED lighting system 600 can utilize the stored electricity as a source of power. In alternate embodiments, the system 600 can be connected to alternate sources of power; for example, a standard household A/C circuit can be used as the power source 630.

The controller 650 is shown in FIG. 6 as a simple box. However, the controller 650 can be a complicated component in the system 600; it can contain a number of components and subcomponents as detailed herein (reference the detailed descriptions of the controller components 250, 350, and 450 in FIG. 2, FIG. 3, and FIG. 4, respectively, above). In the alternative, a simple controller can function similar to an on/off switch. A primary controller function is to control the system 600. It accepts input power in the form of electricity from a power source 630, acts upon the electricity, and uses it to power the LED lights 620, 621, and 622.

Figure 7:
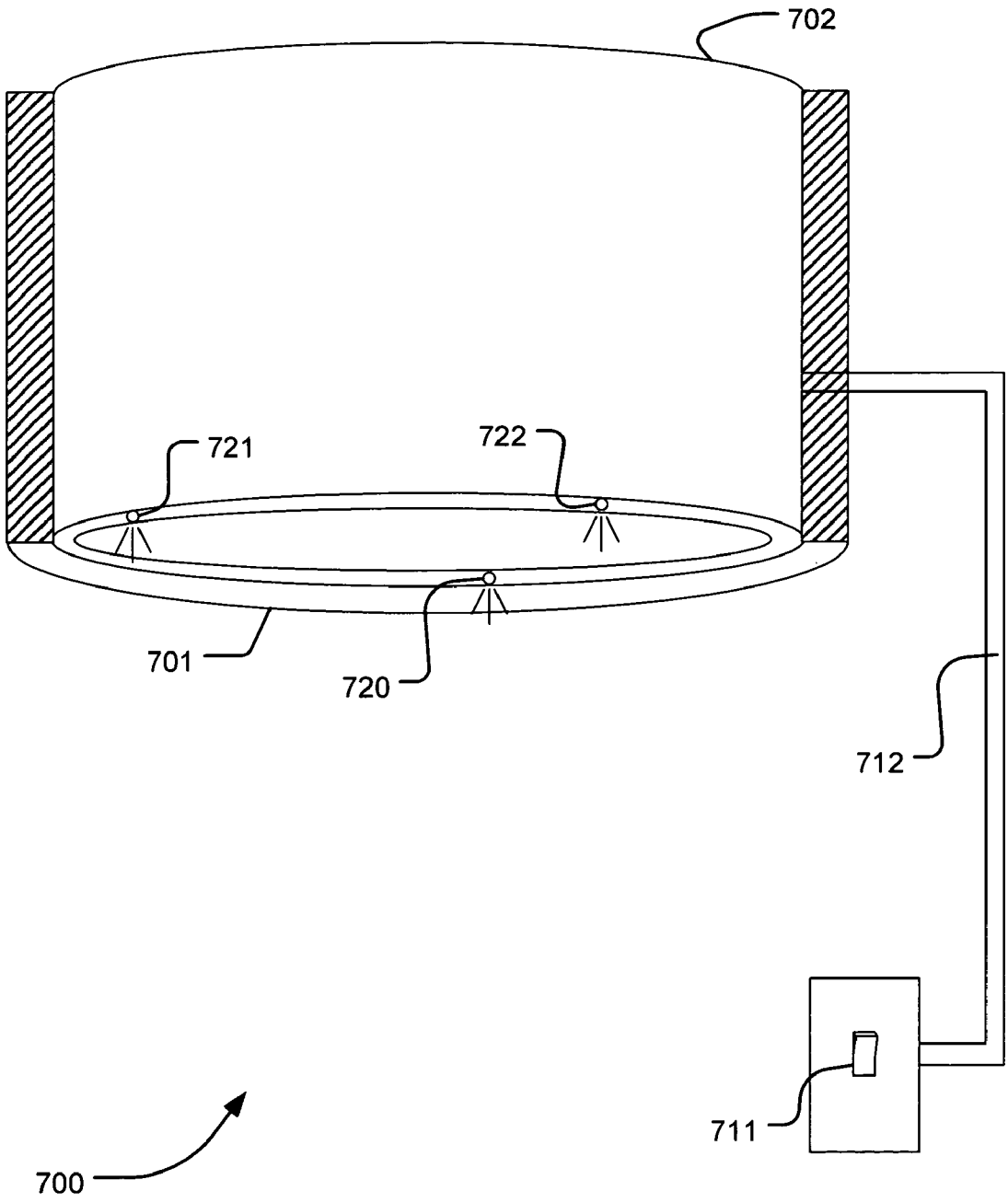
FIG. 7 illustrates a view of an exemplary embodiment of a skylight LED lighting system and utilizing a wall-mountable switch.

FIG. 7 illustrates a view of an exemplary embodiment of a skylight LED lighting system 700 utilizing a wall-mountable switch 711. A skylight LED lighting system 700 is shown installed within a tube-style skylight 701. As noted above, the system 700 can be installed in other types and styles of skylights. Furthermore, the shape and size of the system housing 702 can vary considerably from the embodiment shown in FIG. 7 in order to facilitate installation of the system, for aesthetic appearance, etc., without departing from the scope of the invention.

As illustrated in FIG. 7, the wall-mountable switch 711 can be used by a person to control the system. In the embodiment shown in FIG. 7, the switch 711 is mounted on a wall. Other locations, types, and styles of switches are contemplated in alternate embodiments. The switch 711 can be a simple on/off switch as shown in FIG. 7, or it can be a more complicated switching device. In one embodiment, the switch 711 could have a dimming capability. In yet another embodiment, the switch 711 could incorporate a timer to automatically control the LED lights 720, 721, and 722. Yet more switching alternatives are contemplated, including, but not limited to: switches that control each individual LED light separately; switches that respond to user voice commands; switches that store, recall, and initiate user-lighting patterns; switches that are aware of available power and user lighting requirements and automatically adjust to compensate for various levels of available power; etc.

The wall-mountable switch 711 shown in FIG. 7 utilizes a wire 712 that attaches it to the system housing 702 in order to communicate user commands. In an alternate embodiment, the switch 711 functions wirelessly.

Figure 8:
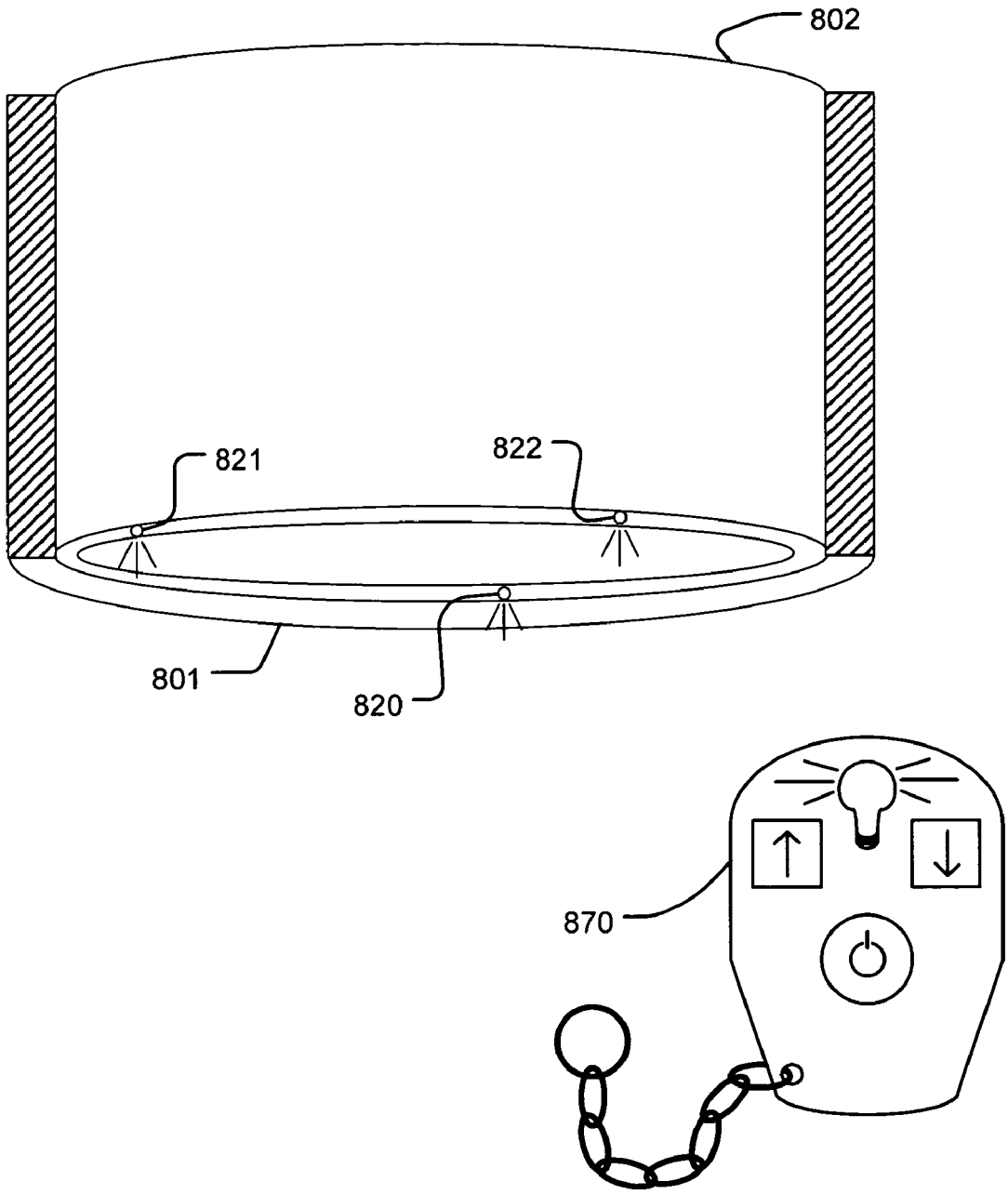
FIG. 8 illustrates a view of an exemplary embodiment of a skylight LED lighting system utilizing a radio frequency remote switch.

FIG. 8 illustrates a view of an exemplary embodiment of a skylight LED lighting system 800 utilizing a radio frequency remote switch 870. As illustrated in FIG. 8, the remote switch 870 can be used by a person to control the system 800. The remote switch 870, as shown in FIG. 8, can function as an on/off switch with brightening and dimming capabilities. In an alternate embodiment, the remote switch 870 has only on/off functionality. In yet another embodiment, the remote switch 870 can be a more complicated switching device. For example, a remote switch 870 could incorporate a timer to automatically control the LED lights 820, 821, and 822. Yet more remote switching alternatives are contemplated, including, but not limited to: remote switches that control each individual LED light separately; remote switches that respond to user voice commands; remote switches that store, recall, and initiate user-lighting patterns; remote switches that are aware of available power and user lighting requirements and automatically adjust to compensate for various levels of available power; etc. In addition, skylight LED lighting systems 800 are contemplated that incorporate both a wall-mountable switch 711 and a remote switch 870. As shown in FIG. 8, the remote switch 870 is a keychain-style remote. In other embodiments, other sizes, styles and types of switches are contemplated.

A skylight LED lighting system 800 is shown installed within a tube-style skylight 801. As noted above, the system 800 can be installed in other types and styles of skylights. Furthermore, the shape and size of the system housing 802 can vary considerably from the embodiment shown in FIG. 8 in order to facilitate installation of the system, for aesthetic appearance, etc., without departing from the scope of the invention.

Figure 9:
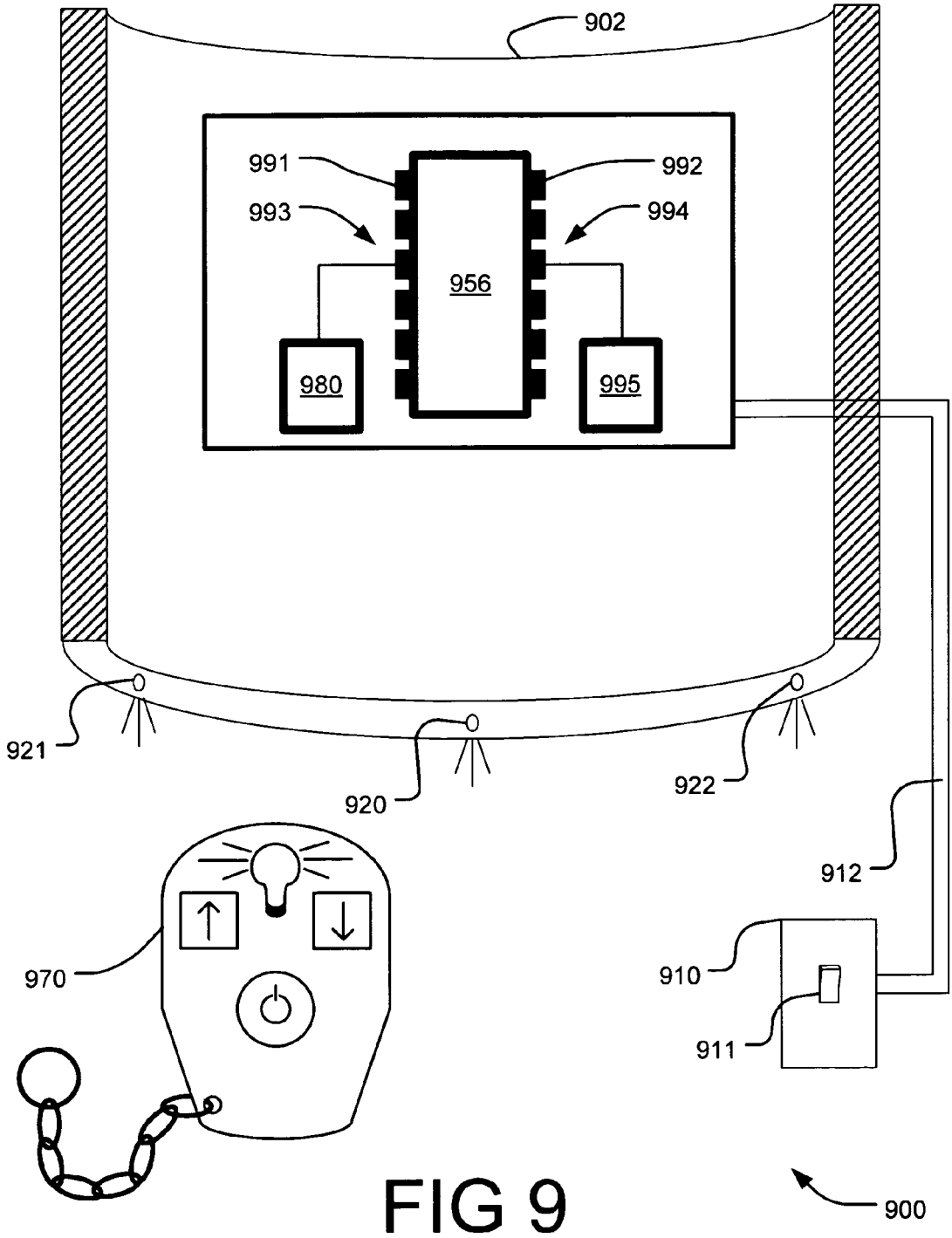
FIG. 9 illustrates a view of an exemplary embodiment of a microchip controller component of a skylight LED lighting system.

FIG. 9 illustrates a view of an exemplary embodiment of a microchip controller component 956 of a skylight LED lighting system 900. As mentioned above, the shape and size of the system housing 902 can vary considerably from the embodiment shown in FIG. 9 in order to facilitate installation of the system, for aesthetic appearance, etc., without departing from the scope of the invention. Furthermore, the number of LED lights 920, 921, and 922 can vary as well.

As can be seen in FIG. 9, there are a number of inputs and outputs associated with the microchip 956. One input, the power supply input 991, provides the microchip 956 with its supply of power. In the exemplary embodiment in FIG. 9, the power supply input 991 receives five volts of clean, regulated D/C power. Other voltages and types of power are contemplated. A second input, the switch input 992, is shown in FIG. 9: it extends from the switch 911 in the wall plate 910 to the microchip 956 via a wire 912. The switch 911 is triggered manually by a user and signals to the microchip 956 that the skylight LED lighting system 900 should either be dimmed or brightened. In other embodiments, the switch 911 sends much more complicated and actionable information to the microchip 956, either via a wire 912 or wirelessly or a combination thereof. In response, the microchip 956 enters a repeating loop process in which the microchip 956 first determines whether the switch 911 is activated. If it is, the microchip 956 then determines the switch state of the switch 911: the switch state is set to brighten or the switch state is set to dim. In the first case, the microchip 956 increases the intensity level of the light output by the system 900 and then enters a programmable-length delay mode before restarting the loop. In the second case, the microchip 956 decreases the intensity level of the light output by the system 900 and then enters a programmable-length delay mode before restarting the loop. At the beginning of the loop, the microchip 956 once again determines whether the switch 911 is active or inactive. If active, the loop progresses as above. If inactive, the microchip 956 exits the loop and holds steady the brightness level of the system 900.

In another embodiment, the microchip 956 uses RF inputs 993 to determine the status of the RF interface 980. The RF interface 980 receives input signals from the RF remote switch 970. These input signals tell the RF interface 980 what status to report. If the RF interface 980 has an active status and the switch 911 is also active then the microchip 956 enters a programmable-length delay mode before restarting the loop and again determining whether the switch 911 and the RF interface 980 are active. If only one of the two is active, the microchip 956 then determines whether the switch 911 or the RF interface 980 is set to brighten or dim. Once that determination is completed, the loop progresses as above: the microchip 956 appropriately modifies the intensity level of the output of the LED lights 920, 921 and 922, enters a programmable delay period, and then restarts the loop. If neither the switch 911 nor the RF interface 980 is active, the microchip 956 takes no overt action.

In an alternative embodiment, the microchip 956 utilizes a non-volatile memory (NVM) 995 component. The NVM 995 allows the microchip 956 to reset itself to a user-defined or otherwise predetermined brightness/intensity level for the LED lights 920, 921 and 922 if the power is lost to the skylight LED lighting system 900. The NVM can store additional defaults or user-specified information that can be used by the system 900.

In yet other embodiments, the microchip 956 receives other inputs and incorporates them into in its decision process in order to determine appropriate output commands that it should give. Additionally, the microchip 956 could have other outputs as well.

Figure 10:
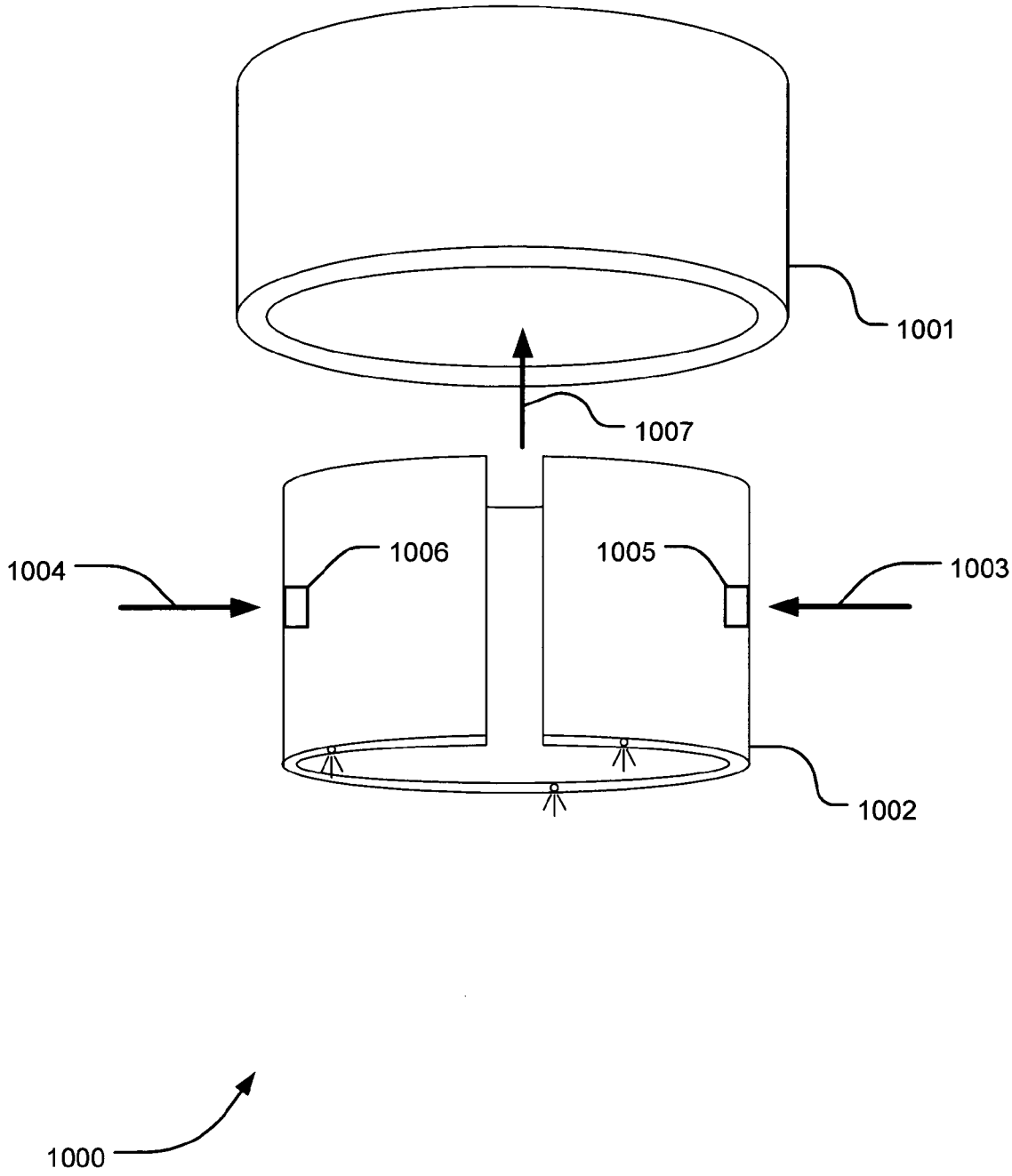
FIG. 10 illustrates a view of a compressed skylight LED lighting system prior to insertion in a tube-style skylight.

FIG. 10 illustrates a view of a compressed skylight LED lighting system 1000 prior to insertion in a tube-style skylight 1001. As above, other sizes and styles of skylights 1001 are contemplated. Furthermore, the system housing 1002 can vary in size, style, shape, and appearance from that shown in FIG. 10 without departing from the scope of the invention.

The system housing 1002 is illustrated in FIG. 10 as being a round, cylindrically-shaped device. The housing 1002 has a break in the cylindrical-shape so as to allow the overall outside diameter of the housing 1002 to be increased or decreased. When the housing 1002 is not under compression, it is preferred that the overall outside diameter of the housing 1002 be larger than the inside diameter of the skylight 1001. When a user applies inward pressure 1003 to installation pressure point 1005 and inward pressure 1004 to installation pressure point 1006, the housing 1002 is put under compression and the overall outside diameter of the housing 1002 decreases. The housing 1002 can then be pushed up 1007 inside the skylight 1001 since the overall outside diameter of the housing 1002 is now less than the inside diameter of the skylight 1001. When the user then relaxes the inward pressures 1003 and 1004 from the housing 1002, the flexible property of the housing 1002 causes the housing 1002 to expand back towards its original dimensions. The overall outside diameter of the housing 1002 therefore increases until it is impeded by the interior walls of the skylight 1001. The housing 1002 then exerts an outward pressure on the interior wall of the skylight 1001. The pressure is sufficient to maintain the housing 1002 in place within the skylight 1001. Nevertheless, double-sided adhesive safety tape can be used to ensure the security and stability of the installation.

In an alternate embodiment, the skylight 1001 has a flange on its bottom interior edge, thus holding the housing 1002 within the skylight 1001. In yet other embodiments, traditional methods of attaching the housing 1002 to the skylight 1001 are contemplated.

The above specification, examples and data provide a description of the structure and use of exemplary embodiments of the described articles of manufacture and methods. Many embodiments can be made without departing from the spirit and scope of the invention.

What is claimed is:

1. A skylight LED lighting system shaped so as to fit within a skylight and provide an alternative light source when natural light from the skylight is not available, comprising:

a housing having a plurality of LED lights;

a LED controller having at least one microchip; and a power source wherein the housing having a non-compressed first outside diameter that is larger than an inside diameter of the skylight and a compressed second outside diameter that is smaller than the inside diameter of the skylight; the housing is flexible and is compressed such that the housing decreases in size from the first outside diameter to the second outside diameter; the second outside diameter is such that when under compression the housing fits within an end of the skylight; when compression is removed, the housing expands in size from the second outside diameter towards the first outside diameter which places the housing in contact with the skylight and holds the housing within the skylight; and wherein the power source comprises at least a solar cell mounted within the skylight and using light transmitted through the skylight to produce power.

2. The skylight LED lighting system of claim 1, wherein the LED controller has a plurality of terminal blocks and the terminal blocks accept an input power from the power source.

3. The skylight LED lighting system of claim 2, wherein the terminal blocks transfer the input power to a bridge rectifier;

the bridge rectifier transforms the input power to a direct current;

the bridge rectifier transfers the direct current to a capacitor; and the capacitor transfers the direct current to the microchip.

4. The skylight LED lighting system of claim 3, wherein the microchip is a programmable code-based microchip utilizing an oscillation chip with a plurality of incremental steps for smoothly brightening and dimming the plurality of LED lights without the use of a pulse width modulation device.

5. The skylight LED lighting system of claim 2, wherein the terminal blocks transfer the input power to a voltage regulator;

the voltage regulator regulates the input power to a predetermined voltage; and the voltage regulator transfers the regulated input power to the microchip.

6. The skylight LED lighting system of claim 5, wherein the microchip is a programmable code-based microchip utilizing an oscillation chip with a plurality of incremental steps for smoothly brightening and dimming the plurality of LED lights without the use of a pulse width modulation device.

7. A skylight LED lighting system designed to provide an alternative light source when natural light from the skylight is not available, comprising:

a power source; and a housing having a plurality of LED lights, wherein the housing is shaped and sized to fit within an interior terminating end of a skylight wherein the housing having a non-compressed first outside diameter that is larger than an inside diameter of the skylight and a compressed second outside diameter that is smaller than the inside diameter of the skylight; the housing is flexible and is compressed such that the housing decreases in size from the first outside diameter to the second outside diameter; the second outside diameter is such that when under compression the housing fits within an end of the skylight; when compression is removed, the housing expands in size from the second outside diameter towards the first outside diameter which places the housing in contact with the skylight and holds the housing within the skylight.

8. The skylight LED lighting system of claim 7, wherein the power source comprises at least a solar cell mounted within the skylight and using light transmitted through the skylight to produce power.

9. The skylight LED lighting system of claim 8, further comprising:

a LED controller having a microchip utilizing an oscillation chip with a plurality of incremental steps for smoothly brightening and dimming the plurality of LED lights without the use of a pulse width modulation device.

10. The skylight LED lighting system of claim 9, wherein a means for controlling the microchip is a switch which allows a user to at least smoothly brighten or dim the plurality of LED lights.

11. The skylight LED lighting system of claim 10, wherein the switch is a radio frequency remote switch.

12. The skylight LED lighting system of claim 7, further comprising:

a LED controller having a microchip.

13. The skylight LED lighting system of claim 12, wherein a means for controlling the microchip is a switch which allows a user to at least smoothly brighten or dim the plurality of LED lights.

14. The skylight LED lighting system of claim 12, wherein a means for controlling the microchip is a radio frequency remote switch which allows a user to at least turn on and off the plurality of LED lights.

15. The skylight LED lighting system of claim 12, wherein the microchip utilizes non-volatile memory.

16. A method of installing a skylight LED lighting system shaped so as to fit within a skylight and provide an alternative light source when natural light from the skylight is not available, wherein the system has a power source and a flexible housing having a plurality of LED lights and wherein the housing has a non-compressed outside diameter, comprising:

placing compression upon the flexible housing such that the non-compressed outside diameter of the housing is decreased until it is less than an inside diameter of a skylight;

inserting the housing into an end of the skylight;

removing compression from the housing;

allowing the housing to expand such that the outside diameter of the housing increases towards the non-compressed outside diameter; and causing the housing to hold fast to the interior of the skylight.

17. The method of claim 16 wherein the housing has a LED controller having a microchip, wherein the microchip is a programmable code-based microchip utilizing an oscillation chip with a plurality of incremental steps for smoothly brightening and dimming the plurality of LED lights without the use of a pulse width modulation device.

18. The method of claim 17 wherein the power source comprises at least a solar cell mounted within the skylight and using light transmitted through the skylight to produce power.

* * * * *